US012215604B1

(12) United States Patent
Binek et al.

(10) Patent No.: US 12,215,604 B1
(45) Date of Patent: Feb. 4, 2025

(54) COOLING NOZZLE VANES OF A TURBINE ENGINE

(71) Applicant: RTX Corporation, Farmington, CT (US)

(72) Inventors: Lawrence A. Binek, Glastonbury, CT (US); Paul M. Lutjen, Kennebunkport, ME (US); Jose R. Paulino, Jupiter, FL (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 18/394,810

(22) Filed: Dec. 22, 2023

(51) Int. Cl.

| | |
|---|---|
| ***F01D 9/02*** | (2006.01) |
| ***F23R 3/54*** | (2006.01) |
| *F01D 5/18* | (2006.01) |
| *F01D 9/06* | (2006.01) |

(52) U.S. Cl.
CPC ..... *F01D 9/02* (2013.01); *F23R 3/54* (2013.01); *F01D 5/187* (2013.01); *F01D 9/065* (2013.01); *F23R 2900/03044* (2013.01)

(58) Field of Classification Search
CPC ..... F01D 9/023; F01D 5/187; F01D 9/065; F23R 3/002; F23R 3/58; F23R 3/54; F23R 3/16; F23R 2900/03044
See application file for complete search history.

(56) References Cited

U.S. PATENT DOCUMENTS

| | | | | | |
|---|---|---|---|---|---|
| 3,613,360 | A * | 10/1971 | Howes | F23R 3/54 | 60/755 |
| 4,928,479 | A * | 5/1990 | Shekleton | F23R 3/28 | 60/746 |
| 5,033,263 | A * | 7/1991 | Shekleton | F23R 3/06 | 60/800 |
| 5,628,193 | A * | 5/1997 | Kington | F01D 9/023 | 60/752 |
| 11,136,901 | B2 * | 10/2021 | Binek | F23R 3/54 | |
| 11,156,156 | B2 | 10/2021 | Binek | | |
| 11,262,077 | B2 * | 3/2022 | Binek | F23R 3/002 | |
| 11,753,952 | B2 | 9/2023 | Binek | | |
| 11,846,249 | B1 * | 12/2023 | Paulino | F02C 9/18 | |
| 2014/0366544 | A1 * | 12/2014 | Maccaul | F23R 3/06 | 60/752 |
| 2021/0207497 | A1 * | 7/2021 | Binek | F01D 25/26 | |
| 2022/0316408 | A1 * | 10/2022 | Binek | F01D 25/12 | |

* cited by examiner

*Primary Examiner* — Eldon T Brockman
(74) *Attorney, Agent, or Firm* — Getz Balich LLC

(57) ABSTRACT

An assembly is provided for a turbine engine. This assembly includes a nozzle structure and a combustor wall. The nozzle structure includes a first platform, a second platform and a plurality of nozzle vanes arranged circumferentially about an axis. The nozzle vanes extends radially between and are connected to the first platform and the second platform. The combustor wall includes a plurality of apertures. An upstream portion of the combustor wall is radially between and borders a plenum and a combustion chamber. A downstream portion of the combustor wall is radially between and borders the plenum and a gap. The downstream portion of the combustor wall axially overlaps the nozzle structure with the gap formed by and extending between the combustor wall and the first platform. The apertures extends through the downstream portion of the combustor wall and are aligned with the nozzle vanes.

20 Claims, 10 Drawing Sheets

COOLING NOZZLE VANES OF A TURBINE ENGINE

BACKGROUND OF THE DISCLOSURE

1. Technical Field

This disclosure relates generally to a turbine engine and, more particularly, to a stationary structure for the turbine engine.

2. Background Information

A gas turbine engine includes a stationary engine structure for housing and/or supporting internal rotating components of the gas turbine engine. Various stationary engine structures are known in the art. While these known stationary engine structures have various benefits, there is still room in the art for improvement.

SUMMARY OF THE DISCLOSURE

According to an aspect of the present disclosure, an assembly is provided for a turbine engine. This assembly includes a nozzle structure and a combustor wall. The nozzle structure includes a first platform, a second platform and a plurality of nozzle vanes arranged circumferentially about an axis. The nozzle vanes extends radially between and are connected to the first platform and the second platform. The combustor wall includes a plurality of apertures. An upstream portion of the combustor wall is radially between and borders a plenum and a combustion chamber. A downstream portion of the combustor wall is radially between and borders the plenum and a gap. The downstream portion of the combustor wall axially overlaps the nozzle structure with the gap formed by and extending between the combustor wall and the first platform. The apertures extends through the downstream portion of the combustor wall and are aligned with the nozzle vanes.

According to another aspect of the present disclosure, another assembly is provided for a turbine engine. This assembly includes a nozzle structure and a combustor wall. The nozzle structure includes a first platform, a second platform and a plurality of nozzle vanes arranged circumferentially about an axis. Each of the nozzle vanes extends radially from the first platform to the second platform. The combustor wall includes a plurality of apertures. An upstream portion of the combustor wall is radially between and lines a plenum and a combustion chamber. A downstream portion of the combustor wall is radially between and lines the plenum and a channel. The downstream portion of the combustor wall axially overlaps the nozzle structure with the channel formed by and extending between the combustor wall and the first platform. The apertures are configured to direct air, received from the plenum, across the channel and onto a surface of the first platform located opposite the nozzle vanes.

According to still another aspect of the present disclosure, another assembly is provided for a turbine engine. This assembly includes a monolithic body extending axially along and circumferentially about an axis. The monolithic body includes an outer wall, an inner wall, an intermediate structure, a combustor wall, a plenum and a channel. The inner wall is radially inboard of and axially overlaps the outer wall. The intermediate structure extends between and is connected to an axial forward end of the outer wall and an axial forward end of the inner wall. A downstream portion of the combustor wall projects axially to and is connected to the intermediate structure. The plenum is radially between and is formed by the combustor wall and the inner wall. The channel is radially between and is formed by the downstream portion of the combustor wall and the outer wall. A plurality of apertures extend radially across the downstream portion of the combustor wall and fluidly couple the plenum to the channel.

The apertures may include a first aperture. The first aperture may be configured to direct a portion of the air along a trajectory across the channel to a point on the surface of the first platform. The trajectory may be angularly offset from a normal line projecting out from the point on the surface of the first platform by an angle greater than twenty degrees.

The assembly may also include a turbine wall and an intermediate structure. The turbine wall may axially overlap the downstream portion of the combustor wall and border the plenum. The intermediate structure may extend between and may be formed integral with a downstream end of the first platform and an upstream end of the turbine wall. The downstream portion of the combustor wall may extend axially to and may be formed integral with the intermediate structure. The apertures may extend through the downstream portion of the combustor wall.

Each of the apertures may be configured to direct air, received from the plenum, across the gap onto the first platform.

The nozzle vanes may include a first nozzle vane. The apertures may include a first aperture. The first aperture may be axially and circumferentially aligned with the first nozzle vane.

The nozzle vanes may also include a second nozzle vane circumferentially neighboring the first nozzle vane. The apertures may also include a second aperture. The second aperture may be circumferentially aligned with a channel between the first nozzle vane and the second nozzle vane.

Each of the apertures may be circumferentially aligned with a respective one of the nozzle vanes.

The apertures may include a first aperture. The first aperture may extend along a centerline through the downstream portion of the combustor wall from the plenum to the gap. The centerline may be coincident with a point on a surface of the first platform. The centerline may be angularly offset from a normal line projecting out from the point on the surface of the first platform by an acute angle.

The apertures may include a first aperture. The first aperture may extend along a centerline through the downstream portion of the combustor wall from the plenum to the gap. At least a portion of the first aperture along the centerline may have a round cross-sectional geometry.

The apertures may include a first aperture. The first aperture may extend along a centerline through the downstream portion of the combustor wall from the plenum to the gap. At least a portion of the first aperture along the centerline may have a polygonal cross-sectional geometry.

The apertures may include a first aperture. At least a portion of the first aperture may laterally converge as the first aperture extends through the downstream portion of the combustor wall towards the gap.

The apertures may include a first aperture. At least a portion of the first aperture may laterally diverge as the first aperture extends through the downstream portion of the combustor wall towards the gap.

The apertures may include a first aperture. A lateral dimension of the first aperture may (e.g., continuously or incrementally) change as the first aperture extends in (e.g., through) the downstream portion of the combustor wall towards the gap. The lateral dimension, for example, may increase, decrease or fluctuate (e.g., increase and then decrease, or decrease and then increase) as the first aperture extends in the downstream portion of the combustor wall towards the gap.

The apertures may include a first set of apertures and a second set of apertures. The first set of apertures may be arranged in a first circumferential array about the axis. The second set of apertures may be arranged in a second circumferential array about the axis. Each aperture in the second set of apertures may be circumferentially aligned with a respective aperture in the first set of apertures.

The apertures may include a first set of apertures and a second set of apertures. The first set of apertures may be arranged in a first circumferential array about the axis. The second set of apertures may be arranged in a second circumferential array about the axis. Each aperture in the second set of apertures may be circumferentially aligned with a respective circumferentially neighboring pair of apertures in the first set of apertures.

The assembly may also include a turbine wall and an intermediate structure. The turbine wall may axially overlap the downstream portion of the combustor wall and border the plenum. The intermediate structure may extend between a downstream end of the first platform and an upstream end of the turbine wall. The downstream portion of the combustor wall may extend axially to the intermediate structure.

The gap may be fluidly coupled to the combustion chamber at an upstream end of the first platform.

The first platform may be an inner platform radially outboard of and circumscribing the downstream portion of the combustor wall. The second platform may be an outer platform radially outboard of and circumscribing the inner platform.

The assembly may also include a second combustor wall projecting axially to and connected to the second platform. The combustion chamber may extend radially between the combustor wall and the second combustor wall.

The assembly may also include a combustor disposed within the plenum. The combustor may include the combustor wall and the combustion chamber. The nozzle structure may be disposed at an outlet from the combustor.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
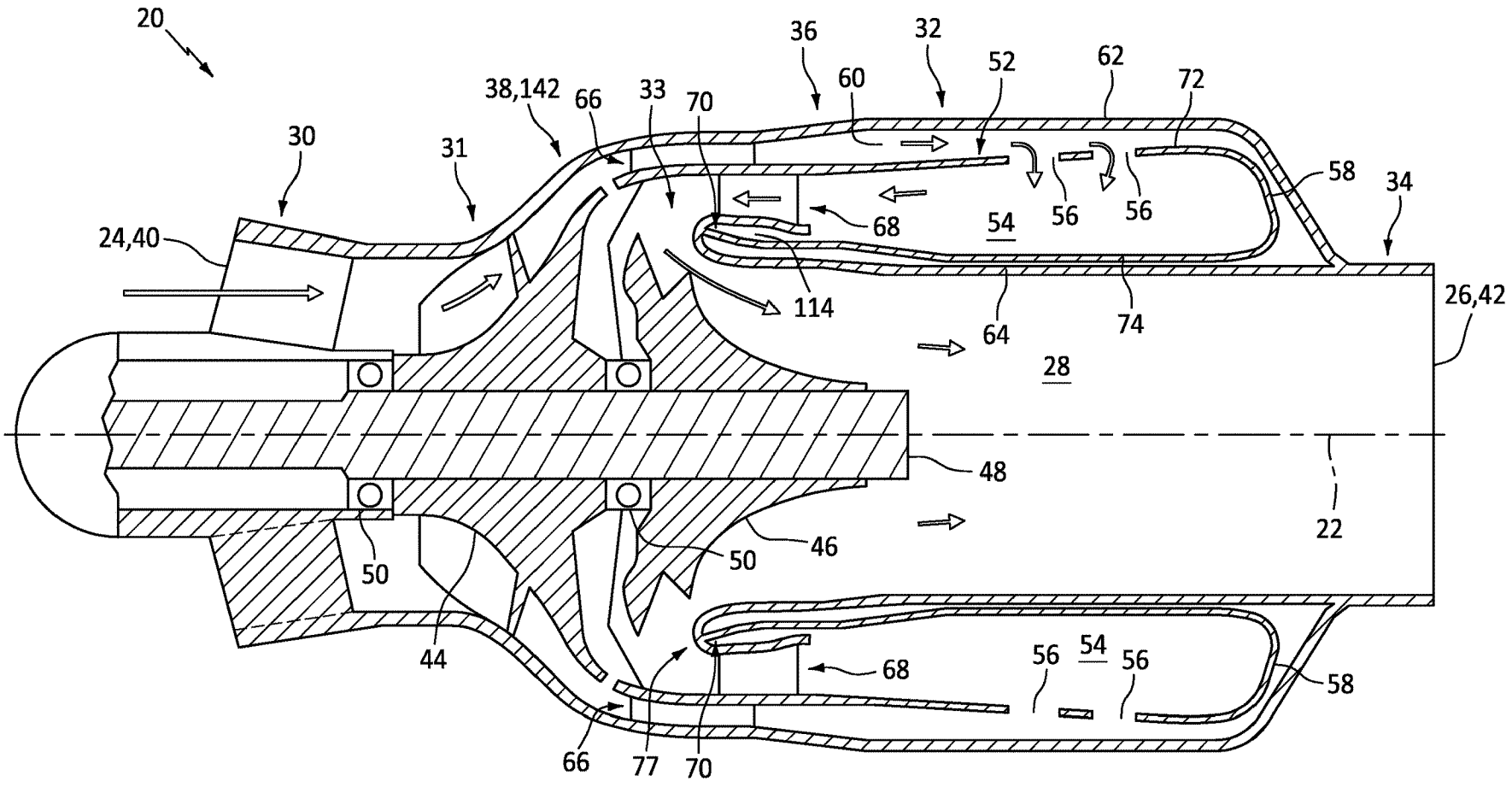
FIG. 1 is a schematic side sectional illustration of a turbine engine.

FIG. 1 is a side sectional illustration of a turbine engine 20. The turbine engine 20 of FIG. 1 is configured as a single spool, radial-flow turbojet gas turbine engine. This turbine engine 20 is configured for propelling an aircraft such as, but not limited to, an airplane, a drone (e.g., an unmanned aerial vehicle (UAV)), a spacecraft or any other manned or unmanned aerial vehicle or system. The present disclosure, however, is not limited to such an exemplary turbojet turbine engine configuration nor to an aircraft propulsion system application. For example, the turbine engine 20 may alternatively be configured as an auxiliary power unit (APU) for the aircraft, or an industrial gas turbine engine.

The turbine engine 20 of FIG. 1 extends axially along an axis 22 from a forward, upstream airflow inlet 24 into the turbine engine 20 to an aft, downstream combustion products exhaust 26 from the turbine engine 20. The axis 22 may be a centerline axis of the turbine engine 20 and/or a centerline axis of various components within the turbine engine 20. The axis 22 may also or alternatively be a rotational axis for various components within the turbine engine 20.

The turbine engine 20 includes a core flowpath 28, an inlet section 30, a compressor section 31, a (e.g., reverse flow) combustor section 32, a turbine section 33 and an exhaust section 34. At least (or only) the compressor section 31, the combustor section 32 and the turbine section 33 may form a core 36 of the turbine engine 20. The turbine engine 20 also includes a stationary structure 38. Briefly, this stationary structure 38 may house and/or form the engine sections 31-33. The stationary structure 38 may also form the engine sections 30 and 34.

The core flowpath 28 extends within the turbine engine 20 and its engine core 36 from an airflow inlet 40 into the core flowpath 28 to a combustion products exhaust 42 from the core flowpath 28. More particularly, the core flowpath 28 of FIG. 1 extends sequentially through the inlet section 30, the compressor section 31, the combustor section 32, the turbine section 33 and the exhaust section 34 between the core inlet 40 and the core exhaust 42. The core inlet 40 of FIG. 1 forms the engine inlet 24 into the turbine engine 20. The core exhaust 42 of FIG. 1 forms the engine exhaust 26 from the turbine engine 20. However, the core inlet 40 may alternatively be discrete and downstream from the engine inlet and/or the core exhaust 42 may alternatively be discrete and upstream from the engine exhaust.

The compressor section 31 includes a bladed compressor rotor 44. The turbine section 33 includes a bladed turbine rotor 46. Each of these engine rotors 44, 46 includes a rotor base (e.g., a hub or a disk) and a plurality of rotor blades (e.g., vanes or airfoils) arranged circumferentially around and connected to the rotor base. The rotor blades, for example, may be formed integral with or mechanically fastened, welded, brazed and/or otherwise attached to the respective rotor base.

The compressor rotor 44 may be configured as a radial flow compressor rotor (e.g., an axial inflow-radial outflow compressor rotor), and the compressor section 31 may be configured as a radial flow compressor section. The turbine rotor 46 may be configured as a radial flow turbine rotor (e.g., a radial inflow-axial outflow turbine rotor), and the turbine section 33 may be configured as a radial flow turbine section. The compressor rotor 44 is connected to the turbine rotor 46 through an engine shaft 48. This engine shaft 48 is rotatably supported by the stationary structure 38 through a plurality of bearings 50; e.g., rolling element bearings, journal bearings, etc.

The combustor section 32 includes an annular combustor 52 with an annular combustion chamber 54. The combustor 52 of FIG. 1 is configured as a reverse flow combustor. Inlet ports 56 and/or flow tubes into the combustion chamber 54, for example, may be arranged at (e.g., on, adjacent or proximate) and/or towards an aft bulkhead wall 58 of the combustor 52. An outlet from the combustor 52 may be arranged axially aft of an inlet to the turbine section 33. The combustor 52 may also be arranged radially outboard of and/or axially overlap at least a (e.g., aft) portion of the turbine section 33. With this arrangement, the core flowpath 28 of FIG. 1 reverses direction (e.g., from a forward-to-aft direction to an aft-to-forward direction) a first time as the core flowpath 28 extends from an annular diffuser plenum 60 surrounding the combustor 52 into the combustion chamber 54. The core flowpath 28 of FIG. 1 then reverses direction (e.g., from the aft-to-forward direction to the forward-to-aft direction) a second time as the core flowpath 28 extends from the combustion chamber 54 into the turbine section. 33.

During turbine engine operation, air enters the turbine engine 20 through the inlet section 30 and its core inlet 40. The inlet section 30 directs the air from the core inlet 40 into the core flowpath 28 and the compressor section 31. The air entering the core flowpath 28 may be referred to as "core air". This core air is compressed by the compressor rotor 44. The compressed core air is directed through a diffuser and its diffuser plenum 60 into the combustion chamber 54. Fuel is injected and mixed with the compressed core air to provide a fuel-air mixture. This fuel-air mixture is ignited within the combustion chamber 54, and combustion products thereof flow through the turbine section 33 and drive rotation of the turbine rotor 46 about the axis 22. The rotation of the turbine rotor 46 drives rotation of the compressor rotor 44 about the axis 22 and, thus, compression of the air received from the core inlet 40. The exhaust section 34 directs the combustion products out of the turbine engine 20 into an environment external to the aircraft to provide forward engine thrust.

Figure 2:
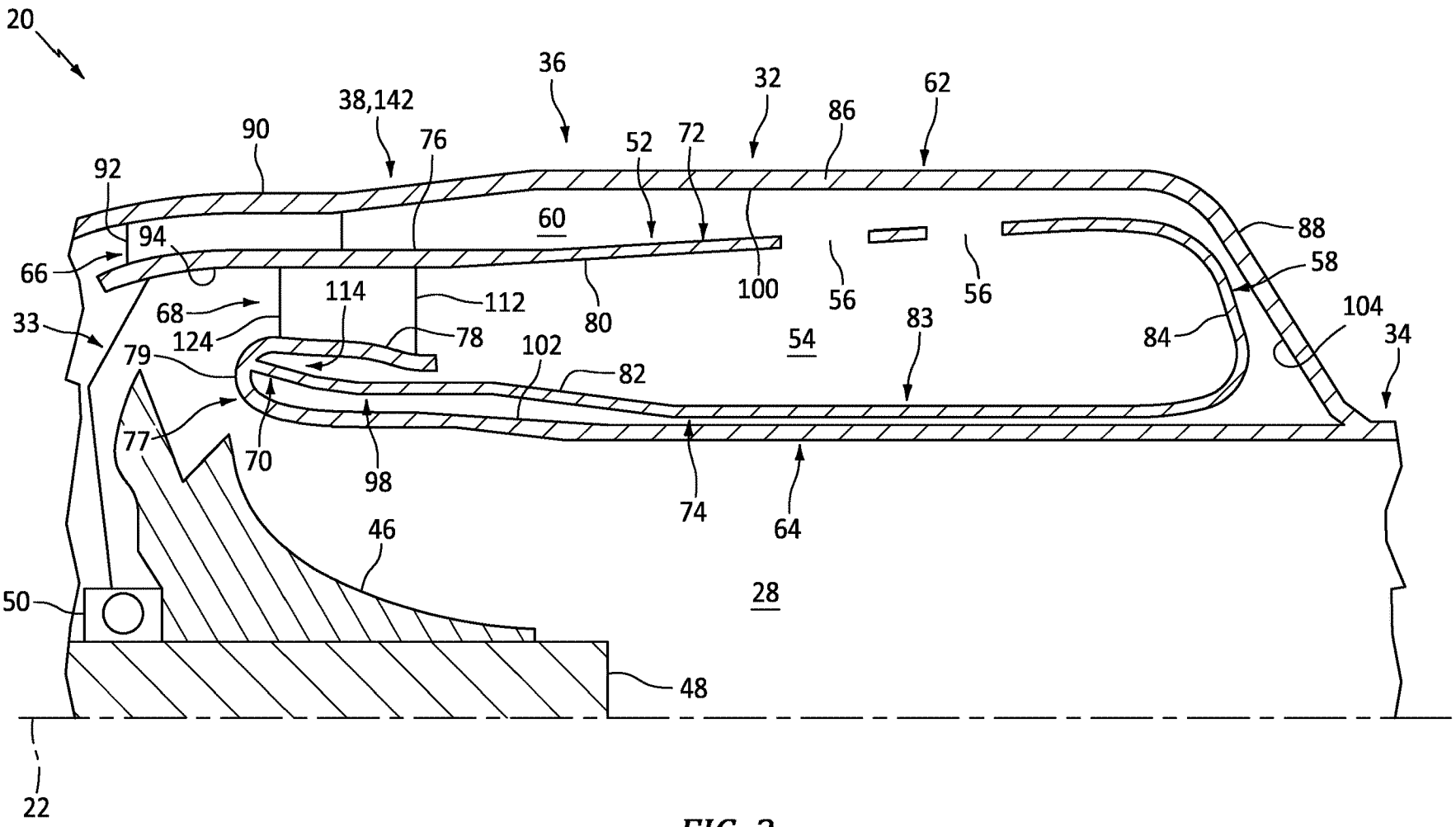
FIG. 2 is a schematic side sectional illustration of a portion of the turbine engine of FIG. 1 at its combustor.

Referring to FIG. 2, the stationary structure 38 includes the combustor 52 and one or more engine walls 62 and 64 (e.g., cases) forming the diffuser plenum 60 along the combustor 52. The stationary structure 38 of FIG. 2 also includes a diffuser nozzle 66, a turbine nozzle 68 and a cooling structure 70 (see also FIG. 3); e.g., a diffuser, a showerhead, etc.

The combustor 52 of FIG. 2 includes a radial outer combustor wall 72, a radial inner combustor wall 74 and the bulkhead wall 58. The combustor 52 and each of its combustor walls 58, 72 and 74 extends circumferentially about (e.g., completely around) the axis 22. The combustor 52 and each of its combustor walls 72 and 74 may thereby have a full-hoop (e.g., tubular) geometry, and the bulkhead wall 58 may have a full-hoop (e.g., annular, frustoconical, etc.) geometry.

The outer combustor wall 72 is arranged axially between the bulkhead wall 58 and the turbine nozzle 68. The outer combustor wall 72 of FIG. 2, for example, projects axially along the axis 22 (e.g., in the forward direction) out from the bulkhead wall 58 to a radial outer platform 76 of the turbine nozzle 68 (turbine nozzle outer platform 76). The outer combustor wall 72 of FIG. 2 is connected to (e.g., formed integral with) the bulkhead wall 58 at a radial outer end of the bulkhead wall 58. The outer combustor wall 72 of FIG. 2 is also connected to (e.g., formed integral with) the turbine nozzle outer platform 76 at an upstream, aft end of the turbine nozzle outer platform 76.

The inner combustor wall 74 is arranged axially between the bulkhead wall 58 and a flowpath wall structure 77 forming a peripheral boundary of the core flowpath 28 in the turbine section 33. The inner combustor wall 74 of FIG. 2, for example, projects axially along the axis 22 (e.g., in the forward direction) out from the bulkhead wall 58 to an (e.g., annular) intermediate structure 79 between a radial inner platform 78 of the turbine nozzle 68 and the turbine wall 64. The inner combustor wall 74 of FIG. 2 is connected to (e.g., formed integral with) the bulkhead wall 58 at a radial inner end of the bulkhead wall 58. The inner combustor wall 74 of FIG. 2 is connected to (e.g., formed integral with) and may be cantilevered from the intermediate structure 79 as described below in further detail.

The bulkhead wall 58 is arranged radially between the outer combustor wall 72 and the inner combustor wall 74. The bulkhead wall 58 of FIG. 2, for example, projects radially (e.g., outward away from the axis 22) out from the inner combustor wall 74 to the outer combustor wall 72. The bulkhead wall 58 of FIG. 2 is connected to the outer combustor wall 72 at an aft end of the outer combustor wall 72. The bulkhead wall 58 of FIG. 2 is connected to the inner combustor wall 74 at an aft end of the inner combustor wall 74.

The combustor walls 58, 72 and 74 collectively form the combustion chamber 54 of FIG. 2 within the combustor 52. An interior surface 80 (e.g., a tubular radial inner surface) of the outer combustor wall 72 borders (e.g., lines) the combustion chamber 54 and, more particularly, forms a radial outer peripheral boundary of the combustion chamber 54. An interior surface 82 (e.g., a tubular radial outer surface) of an upstream portion 83 of the inner combustor wall 74 borders the combustion chamber 54 and, more particularly, forms a radial inner peripheral boundary of the combustion chamber 54. An interior surface 84 (e.g., an annular forward surface) of the bulkhead wall 58 borders the combustion chamber 54 and, more particularly, forms a side peripheral boundary of the combustion chamber 54. The combustion chamber 54 thereby extends radially within the combustor 52 between the inner combustor wall 74 and its interior surface 82 and the outer combustor wall 72 and its interior surface 80. The combustion chamber 54 projects axially into the combustor 52 from the outlet of the combustion chamber 54 (e.g., at the turbine nozzle 68) to the bulkhead wall 58 and its interior surface 84.

The diffuser wall 62 is spaced radially outboard from the combustor 52 and the turbine nozzle 68. The diffuser wall 62 extends axially along the axis 22, and axially overlaps the combustor 52 and its outer combustor wall 72. The diffuser wall 62 may also axially overlap the turbine nozzle 68 and its turbine nozzle outer platform 76. The diffuser wall 62 of FIG. 2, for example, includes a diffuser sidewall 86 and a diffuser endwall 88. The diffuser sidewall 86 projects axially (e.g., in the forward direction) out from the diffuser endwall 88, axially along the outer combustor wall 72 and the turbine nozzle outer platform 76, to the diffuser nozzle 66. This diffuser sidewall 86 of FIG. 2 is connected to (e.g., formed integral with) the diffuser endwall 88 at a radial outer end of the diffuser endwall 88. The diffuser sidewall 86 of FIG. 2 is also connected to (e.g., formed integral with) a radial outer platform 90 of the diffuser nozzle 66 at a downstream, aft end of the turbine nozzle outer platform 76. The diffuser endwall 88 projects radially (e.g., outward away from the axis 22) out from the turbine wall 64, along the bulkhead wall 58, to the diffuser sidewall 86. This diffuser endwall 88 of FIG. 2 is connected to (e.g., formed integral with) the diffuser sidewall 86 at a downstream, aft end of the diffuser sidewall 86, and to the turbine wall 64. The diffuser wall 62 and its members 86 and 88 extend circumferentially about (e.g., completely around) the axis 22. The diffuser wall 62 and its members 86 and 88 may thereby circumscribe the combustor 52 and/or the turbine wall 64.

The diffuser nozzle 66 is a vane array structure. This diffuser nozzle 66 is configured to condition the core air leaving the compressor section 31 (see FIG. 1) and entering the diffuser plenum 60. The diffuser nozzle 66 of FIG. 2, for example, includes one or more diffuser vanes 92 (e.g., guide vanes) configured to impart swirl to the core air. These diffuser vanes 92 are arranged (e.g., equispaced) circumferentially about the axis 22 in an annular diffuser vane array. Each of the diffuser vanes 92 extends radially across the core flowpath 28. Each of the diffuser vanes 92 of FIG. 2, for example, extends radially between and is connected to (e.g., formed integral with) the diffuser nozzle outer platform 90 and a radial inner platform 94 of the diffuser nozzle 66. Here, the diffuser nozzle inner platform 94 may be partially (or completely) formed by the turbine nozzle 68 and its turbine nozzle outer platform 76. However, in other embodiments, the diffuser nozzle inner platform 94 and the turbine nozzle outer platform 76 may be discrete from one another; e.g., axially offset from one another.

The turbine wall 64 is spaced radially outboard of the turbine rotor 46. The turbine wall 64 extends axially along the axis 22, and axially overlaps at least a downstream, aft portion of the turbine rotor 46. The turbine wall 64 extends circumferentially about (e.g., completely around) the axis 22, and circumscribes at least the aft portion of the turbine rotor 46. The turbine wall 64 thereby houses at least the aft portion of the turbine rotor 46. The turbine wall 64 also forms a radial outer peripheral boundary of the core flowpath 28 across at least the aft portion of the turbine rotor 46.

The turbine wall 64 of FIG. 2 is spaced radially inboard from the combustor 52 and the turbine nozzle 68. The turbine wall 64 may be connected to the turbine nozzle inner platform 78 by the intermediate structure 79. This intermediate structure 79 may have a curved and/or folded-over geometry (e.g., a substantially U-shaped geometry, a semicircular geometry, etc.) which extends from an upstream, forward end of the turbine wall 64 to a downstream, forward end of the turbine nozzle inner platform 78. With this arrangement, at least (or only) the turbine wall 64, the turbine nozzle inner platform 78 and the intermediate structure 79 may collectively form the flowpath wall structure 77. The flowpath wall structure 77 wraps around a downstream portion 98 (e.g., an axial forward end portion) of the inner combustor wall 74. With this arrangement, the inner combustor wall 74 and its downstream portion 98 project axially into and across an internal space (e.g., annular space) of the flowpath wall structure 77 to the intermediate structure 79. This internal space is formed by and located radially between the turbine wall 64 and the turbine nozzle 68 and its turbine nozzle inner platform 78. The internal space is also formed by and extends axially to the intermediate structure 79.

The engine walls 62 and 64 collectively form the diffuser plenum 60 of FIG. 2 around the combustor 52. A (e.g., tubular) radial inner surface 100 of the diffuser sidewall 86 forms a radial outer peripheral boundary of the diffuser plenum 60 radially outboard of the combustor 52 and its outer combustor wall 72. A (e.g., tubular) radial outer surface 102 of the turbine wall 64 forms a radial inner peripheral boundary of the diffuser plenum 60 radially inboard of the combustor 52 and its inner combustor wall 74. An (e.g., annular) axial side surface 104 of the diffuser endwall 88 forms a side peripheral boundary of the diffuser plenum 60 axially to a side of the combustor 52 and its bulkhead wall 58. With this arrangement, a radial outer portion of the diffuser plenum 60 extends radially between, is formed by and thereby is bordered by the diffuser wall 62 and the outer combustor wall 72. A radial inner portion of the diffuser plenum 60 extends radially between, is formed by and thereby is bordered by the turbine wall 64 and the inner combustor wall 74 and its upstream and downstream portions 83 and 98. An axial end portion of the diffuser plenum 60 extends axially between, is formed by and thereby is bordered by the diffuser endwall 88 and the bulkhead wall 58. The diffuser plenum 60 may thereby extend axially along each combustor wall 72, 74 and radially along the bulkhead wall 58. With this arrangement, the diffuser plenum 60 may wrap around the combustor 52 from or about the diffuser nozzle 66 to the intermediate structure 79.

The turbine nozzle 68 is a vane array structure. This turbine nozzle 68 is configured to condition the combustion products exiting the combustor 52 and its combustion chamber 54. The turbine nozzle 68 of FIG. 2, for example, includes one or more turbine vanes 112 (e.g., guide vanes) configured to impart swirl to the combustion products. These turbine vanes 112 are arranged (e.g., equispaced) circumferentially about the axis 22 in a turbine vane array. Each of the turbine vanes 112 extends radially across the core flowpath 28. Each of the turbine vanes 112 of FIG. 2, for example, extends radially between and is connected to (e.g., formed integral with) the turbine nozzle outer platform 76 and the turbine nozzle inner platform 78. Here, a radial outer surface of the turbine nozzle inner platform 78 forms a radial inner peripheral boundary of the core flowpath 28 (e.g., axially) through the turbine nozzle 68. A radial inner surface of the turbine nozzle outer platform 76 forms a radial outer peripheral boundary of the core flowpath 28 through the turbine nozzle 68 which is radially opposite the inner peripheral boundary formed by the turbine nozzle inner platform 78.

The turbine nozzle inner platform 78 axially overlaps and is spaced radially outboard from the inner combustor wall 74 and its downstream portion 98. The turbine nozzle inner platform 78 extends circumferentially about (e.g., completely around) the axis 22, and circumscribes the inner combustor wall 74 and its downstream portion 98. With this arrangement, a radial gap 114 (e.g., an annular channel) is formed by and thereby is bordered by, and extends radially between the turbine nozzle inner platform 78 and the inner combustor wall 74 and its downstream portion 98. This radial gap 114 projects axially out from one or more of the elements 78, 79 and/or 98 to the combustion chamber 54, thereby fluidly coupling the radial gap 114 with the combustion chamber 54. The radial gap 114 also extends circumferentially about (e.g., completely around) the axis 22, the inner combustor wall 74 and its downstream portion 98.

Figure 3:
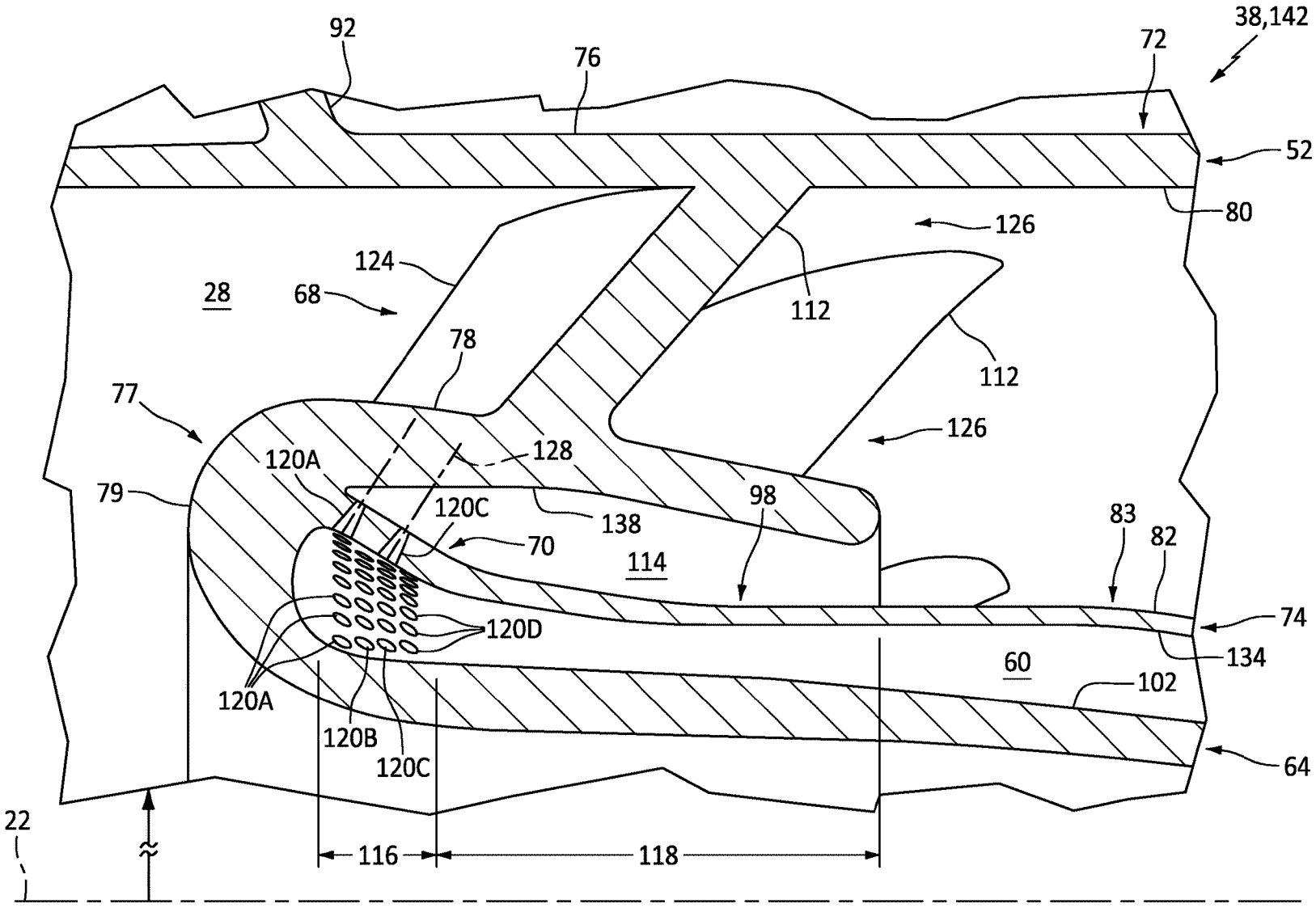
FIG. 3 is a perspective cutaway illustration of a portion of the turbine engine of FIG. 1 with a turbine nozzle and a cooling structure.

Referring to FIG. 3, the cooling structure 70 may be formed as part of the inner combustor wall 74 and its downstream portion 98. The cooling structure 70 of FIG. 3, for example, is configured as a perforated section of the inner combustor wall 74 and its downstream portion 98. This cooling structure 70 is located at or near an axial forward end of the inner combustor wall 74. The cooling structure 70 of FIG. 3, for example, is arranged axially next to the intermediate structure 79, and the cooling structure 70 may project out from the intermediate structure 79 in an axial aft and radial inward direction. A remainder of the downstream portion 98 of the inner combustor wall 74 (or even a remainder of the entire inner combustor wall 74) may be configured as a non-perforated section of the inner combustor wall 74. Here, an axial length 116 of the cooling structure 70 (e.g., the perforated section of the downstream portion 98) is smaller than an axial length 118 of the remainder of the downstream portion 98 (e.g., the non-perforated section of the downstream portion 98). The axial length 118, for example, may be at least two-times (2×), three-times (3×), four-times (4×) greater or five-times (5×) greater than the axial length 116; e.g., up to ten-times (10×) the axial length 116. The present disclosure, however, is not limited to such an exemplary dimensional relationship.

Figure 4:
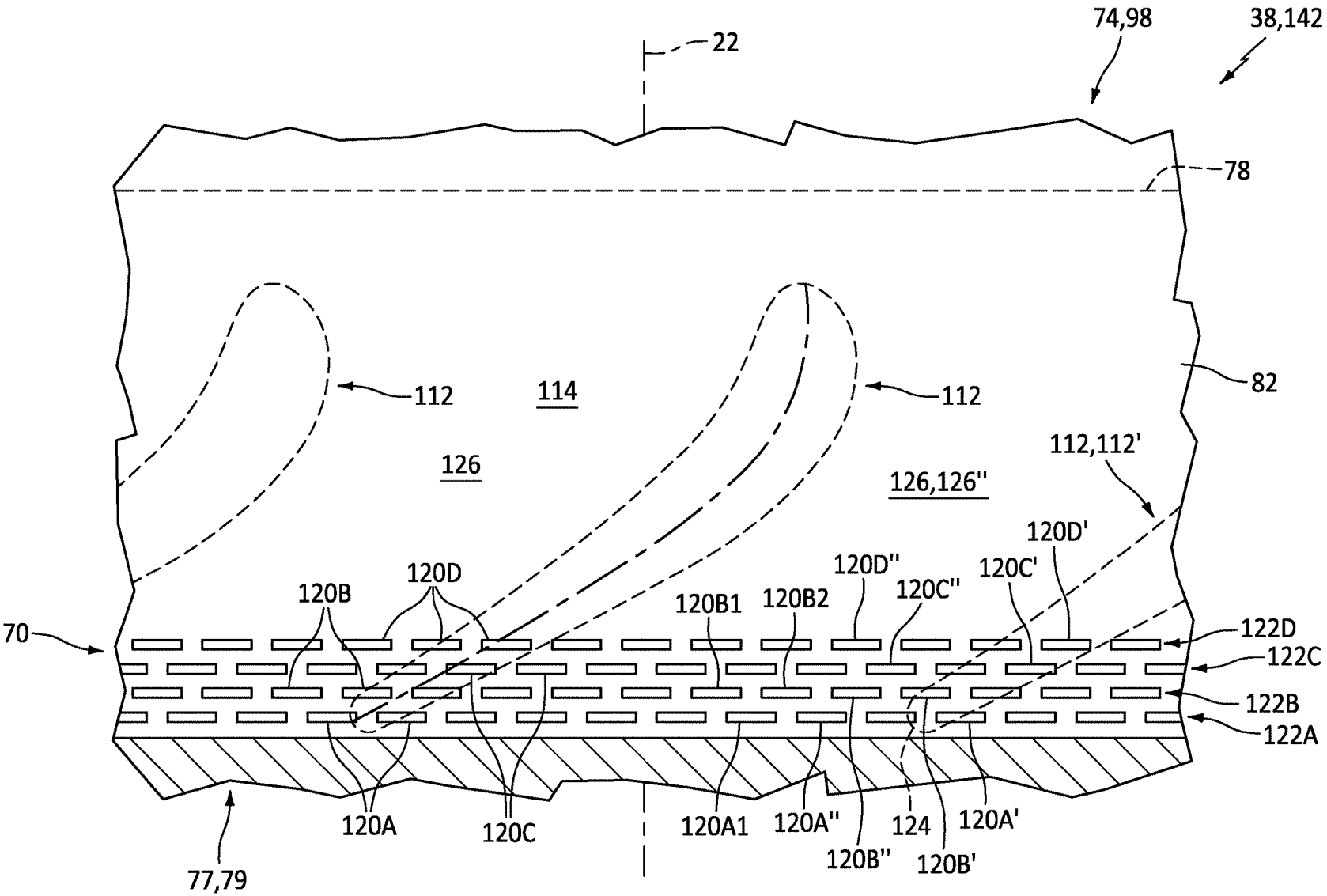
FIG. 4 is a partial plan view illustration of the cooling structure with dashed line vanes of the turbine nozzle overlaid on the cooling structure.
Figure 5:
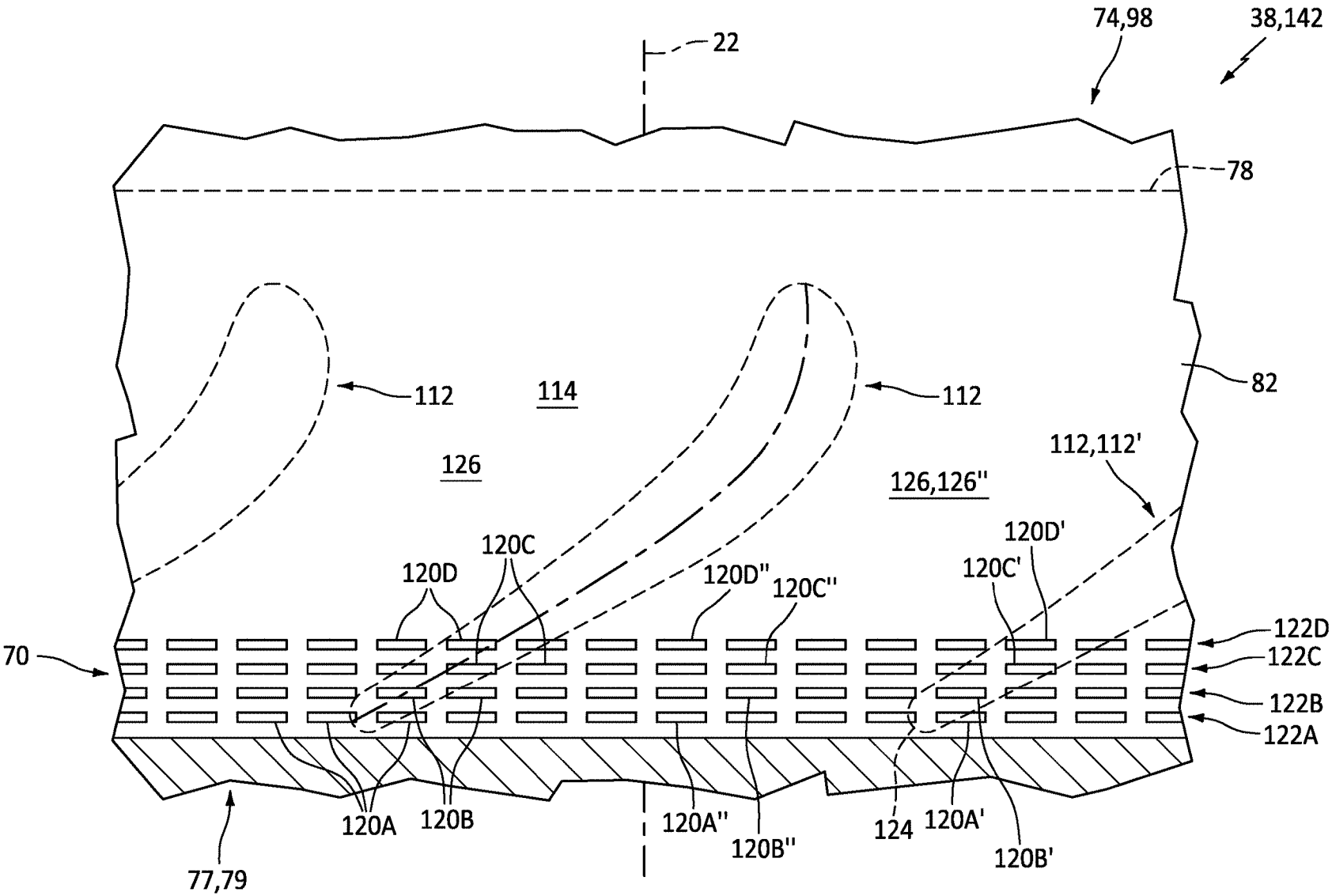
FIGS. 5 and 6 are partial plan view illustrations of alternative cooling structure arrangements with dashed line turbine nozzle vanes of the turbine nozzle overlaid on the cooling structure.

The cooling structure 70 of FIG. 3 includes a plurality of cooling apertures 120A-D (generally referred as "120"). Referring to FIG. 4, these cooling apertures 120 may be divided into one or more sets of the cooling apertures 120, where the cooling apertures 120 in each aperture set are arranged circumferentially about the axis 22 in a circumferential array 122A-D (generally referred as "122"); e.g., a circular array. The cooling apertures 120 in each circumferential array 122 may be axially aligned along the axis 22. The cooling apertures 120 in each circumferential array 122 may also be equispaced circumferentially about the axis 22. The circumferential arrays 122 of FIG. 4 are arranged and may be equispaced axially along the axis 22. The cooling apertures 120 in axially neighboring (e.g., adjacent) circumferential arrays 122 may be circumferentially offset. Each cooling aperture 120 in each circumferential array 122 of FIG. 4, for example, may be circumferentially aligned with a respective circumferentially neighboring pair of the cooling apertures 120 in an axially neighboring circumferential array. The cooling aperture 120A1 of FIG. 4, for example, is circumferentially aligned with an intermediate location circumferentially between the neighboring cooling apertures 120B1 and 120B2. The present disclosure, however, is not limited to such an exemplary inter-array arrangement. For example, referring to FIG. 5, the cooling apertures 120 in axially neighboring circumferential arrays 122 may be circumferentially aligned. Each cooling aperture 120 in each circumferential array 122 of FIG. 5, for example, may be circumferentially aligned with a respective cooling aperture 120 in an axially neighboring circumferential array 122. Moreover, while each circumferential array 122 in FIGS. 4 and 5 is shown with a common (the same) number of cooling apertures 120, it is contemplated different arrays may include different numbers of the cooling apertures 120 in other embodiments.

Figure 6:
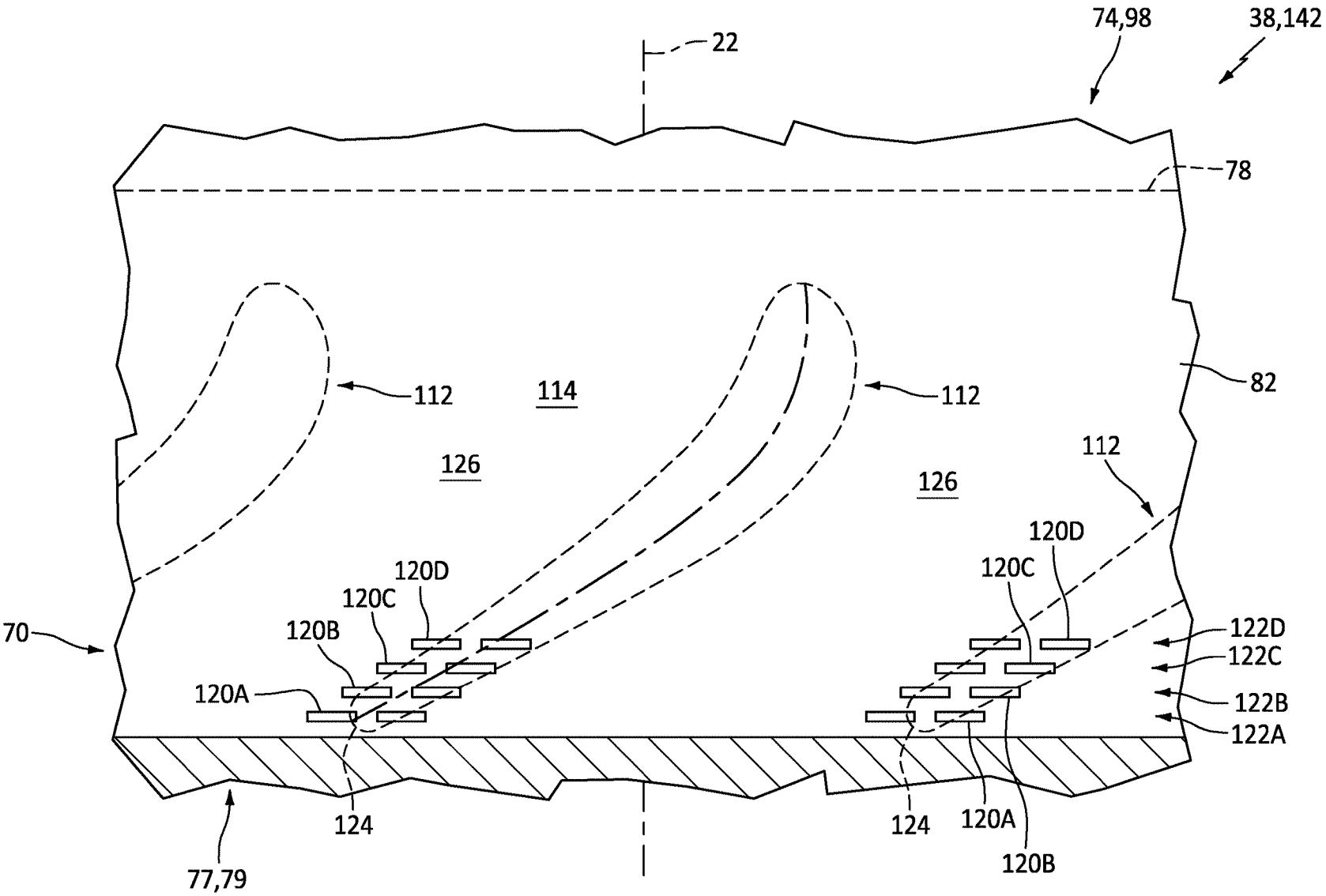

Referring to FIG. 4, at least some of the cooling apertures 120 in each circumferential array 122 may be aligned with some or all of the turbine vanes 112. Each aligned cooling aperture (e.g., 120A', 120B', 120C', 120D') of FIG. 4, for example, is circumferentially aligned with a respective turbine vane (e.g., 112'). Each aligned cooling aperture (e.g., 120A', 120B', 120C', 120D') may also be axially aligned with the respective turbine vane (e.g., 112'), for example at or near a trailing edge 124 of that respective turbine vane (e.g., 112'). Others of the cooling apertures 120 in each circumferential array 122 may be aligned with flow channels 126 between circumferentially neighboring sets of the turbine vanes 112, and misaligned from the turbine vanes 112. Each misaligned cooling aperture (e.g., 120A", 120B", 120C", 120D") of FIG. 4, for example, is circumferentially aligned with a respective flow channel (e.g., 126") between a respective circumferentially neighboring pair of the turbine vanes 112. Each misaligned cooling aperture (e.g., 120A", 120B", 120C", 120D") may also be axially aligned with the respective flow channel (e.g., 126"), for example at or near an outlet from that respective flow channel (e.g., 126"). In other embodiments, referring to FIG. 6, it is contemplated some or all of the misaligned cooling aperture in one, some or all of the circumferential arrays 122 may be omitted. Thus, each cooling aperture 120 may be circumferentially aligned with a respective one of the turbine vanes 112.

Figure 7:
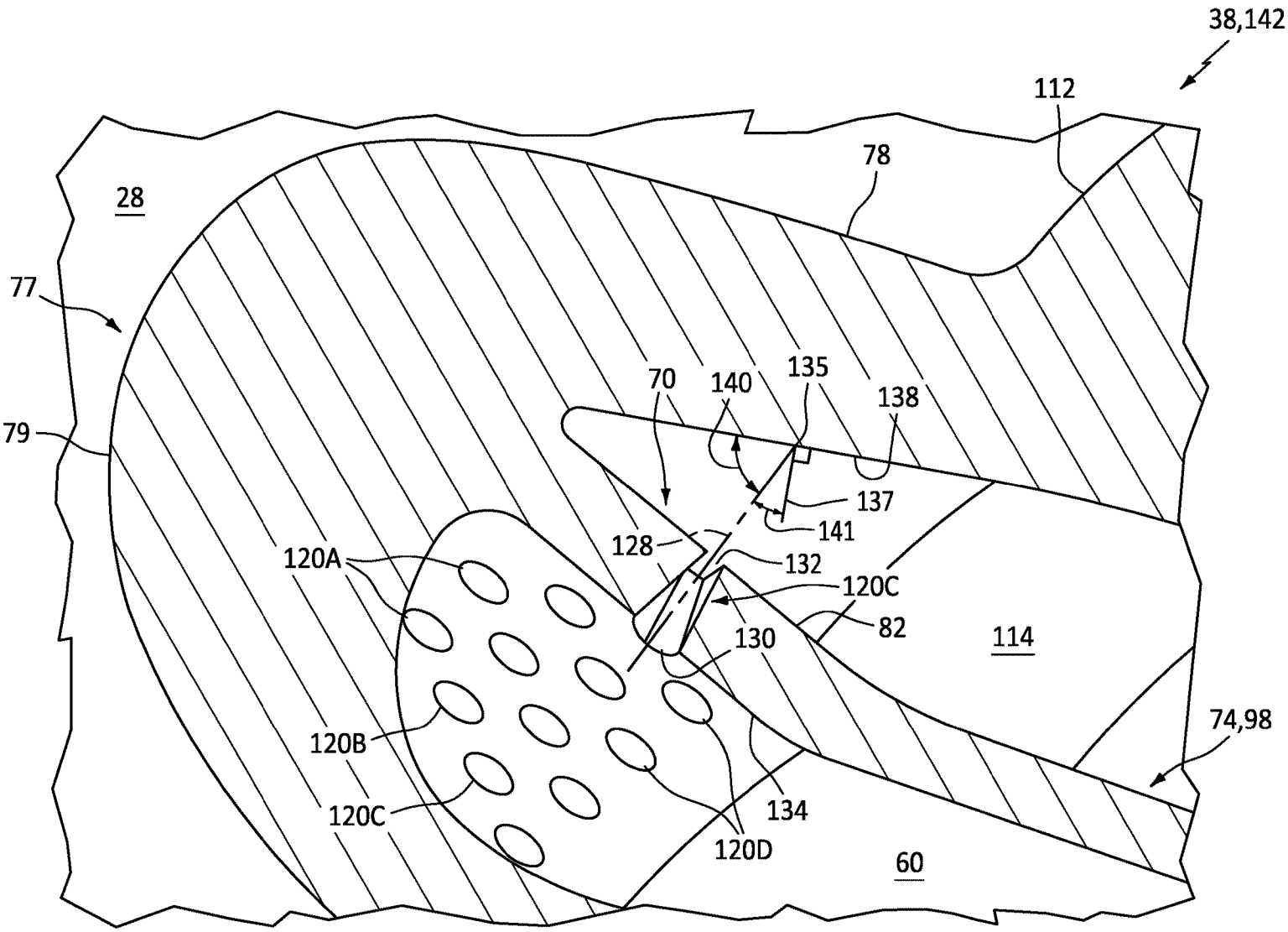
FIG. 7 is a perspective cutaway illustration of a portion of the turbine engine of FIG. 3 at an inner surface of the cooling structure.
Figure 8:
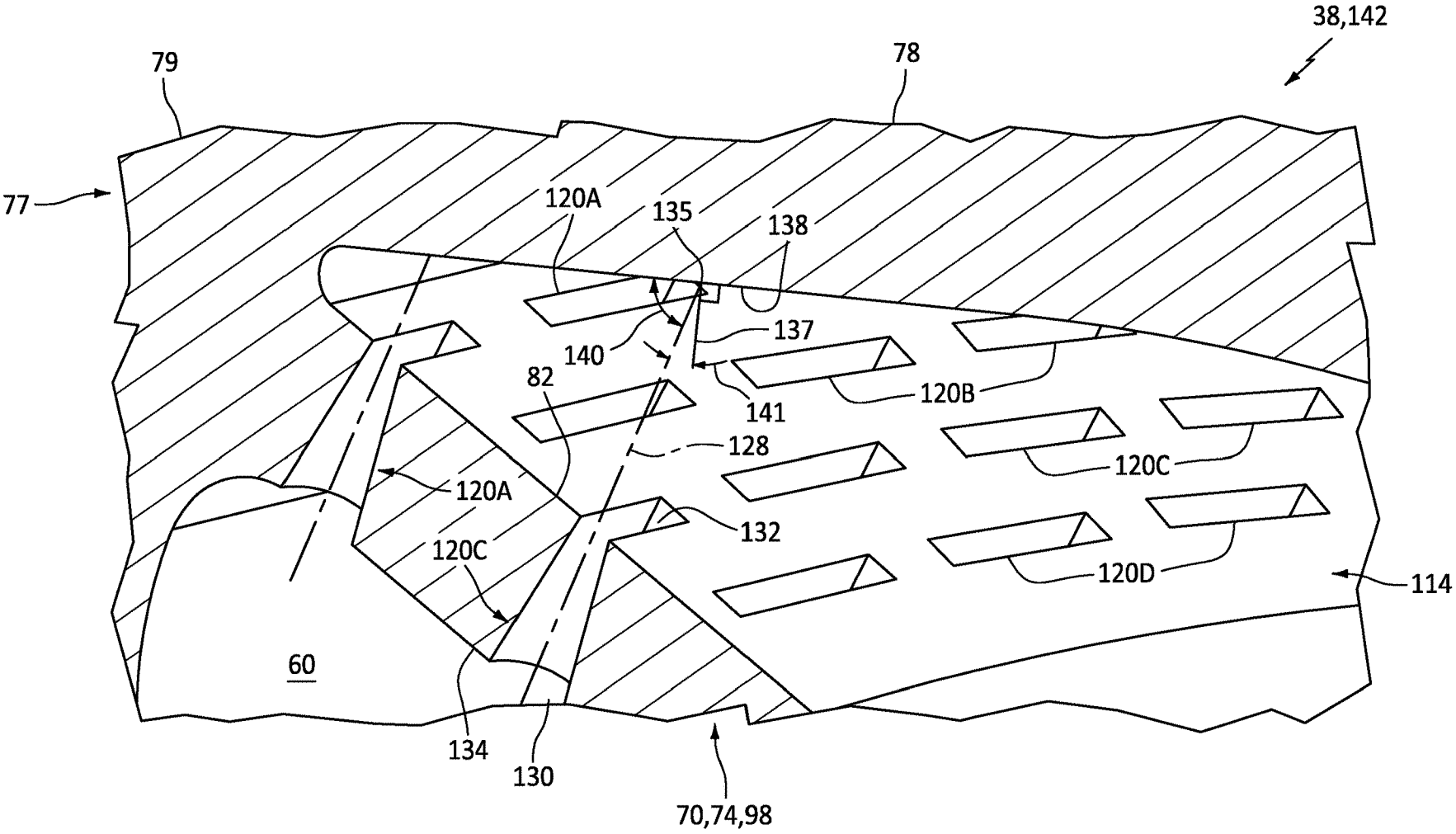
FIG. 8 is a perspective cutaway illustration of a portion of the turbine engine of FIG. 3 at an outer surface of the cooling structure.

Referring to FIGS. 7 and 8, each cooling aperture 120 extends longitudinally along a centerline 128 of the respective cooling aperture 120 through the downstream portion 98 of the inner combustor wall 74. More particularly, each cooling aperture 120 extends longitudinally along its centerline 128 through the cooling structure 70 from an inlet 130 into the respective cooling aperture 120 to an outlet 132 from the respective cooling aperture 120. The aperture inlet 130 of FIGS. 7 and 8 is disposed in a radial inner surface 134 of the downstream portion 98 of the inner combustor wall 74. The aperture outlet 132 of FIGS. 7 and 8 is disposed in the outer surface 82 of the downstream portion 98 of the inner combustor wall 74. With this arrangement, the cooling apertures 120 fluidly couple the diffuser plenum 60 with the radial gap 114 and, thus, the combustion chamber 54 through the radial gap 114 (see FIG. 3).

The centerline 128 (when extended out) is coincident with a point 135 on a radial inner surface 138 of the turbine nozzle inner platform 78. The centerline 128 is angularly offset from the inner surface 138 of the turbine nozzle inner platform 78 by an included angle 140 when viewed, for example, in a reference plane parallel with (e.g., including) the axis 22; e.g., plane of FIG. 3. The angle 140 may be a non-zero acute angle such as between twenty degrees (20°) and seventy degrees (70°) and, more particularly, between thirty-five degrees (35°) and fifty-five degrees (55°); e.g., forty-five degrees (45°). The centerline 128 may also be angularly offset from a normal line 137 projecting out from the point 135 by an included angle 141, where this normal line 137 is perpendicular to the inner surface 138 at the point 137. The angle 141 may be a non-zero acute angle such as between five degrees (5°) and forty-five degrees (45°); e.g., between five degrees (5°) and fifteen degrees (15°), between fifteen degrees (15°) and thirty degrees (30°), or between thirty degrees (30°) and forty-five degrees (45°). The present disclosure, however, is not limited to such an exemplary arrangement. For example, in other embodiments, the angle 140 may be greater than seventy degrees (70°), or may alternatively be a right angle (90°), and/or the angle 141 may be less than five degrees (5°) (e.g., the centerline 128 and the normal line 137 may be parallel (e.g., coaxial) with one another.

While the centerline 128 of FIGS. 7 and 8 is angularly offset from the inner surface 138 of the turbine nozzle inner platform 78, the centerline 128 may be perpendicular or close to perpendicular to the combustor wall inner and outer surfaces 134 and 82. Here, the cooling structure 70 is canted radially outward relative to the turbine nozzle inner platform 78 to provide the angle 140. However, in other embodiments, the centerline 128 may also or alternatively be angularly offset from the combustor wall inner and/or outer surfaces 134 and/or 82 to contribute to or fully provide the angle 140, for example where the cooling structure 70 is parallel with the turbine nozzle inner platform 78.

Referring to FIG. 3, during turbine engine operation, some of the compressed core air (e.g., cooling air) is directed from the diffuser plenum 60 into the radial gap 114 by the cooling apertures 120. Each cooling aperture 120, for example, directs a stream (e.g., a jet, a diffused flow, etc.) of the cooling air across the radial gap 114 onto the inner surface 138 of the turbine nozzle inner platform 78 along a trajectory, which trajectory may be coaxial with the centerline 128 of the respective cooling aperture 120. This stream of cooling air may impinge against the inner surface 138 of the turbine nozzle inner platform 78 to impingement cool the turbine nozzle inner platform 78. The stream of cooling air may also or alternatively coalesce with other streams of the cooling air to form a blanket of cooling air. This blanket of cooling air may flow along/wash over the (e.g., entire) inner surface 138 of the turbine nozzle inner platform 78 to film cool the turbine nozzle inner platform 78. Such impingement cooling and/or film cooling of the turbine nozzle inner platform 78 may facilitate cooling of the turbine vanes 112 by drawing heat energy out of the turbine vanes 112 into the turbine nozzle inner platform 78 for convention into the cooling air. The cooling structure 70 and its cooling apertures 120 are thereby operable to cool the turbine nozzle 68 and its turbine vanes 112 during turbine engine operation. Cooling the turbine nozzle 68 and its turbine vanes 112 reduces an operating temperature of the turbine vanes 112, which may reduce thermal erosion and/or degradation of the turbine vanes 112.

Figure 10:
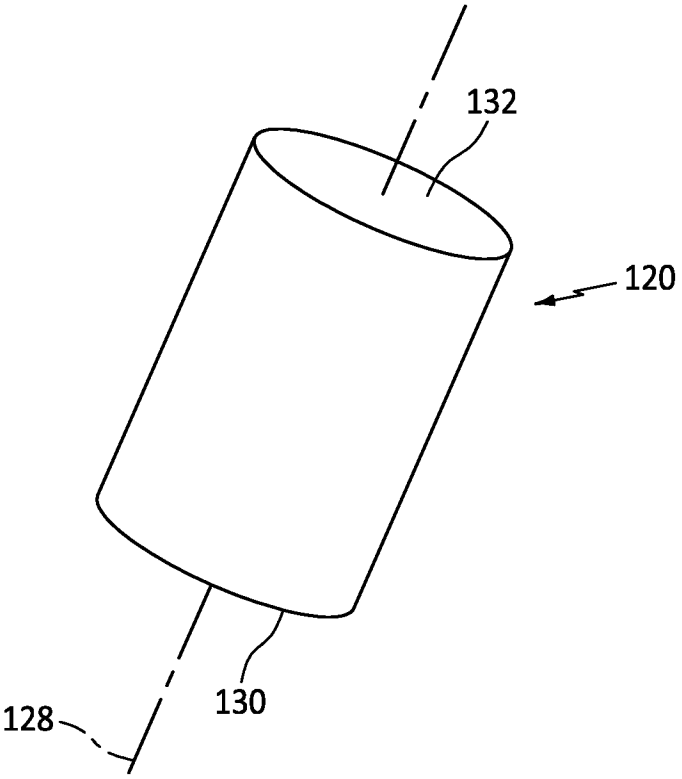
FIGS. 9 and 10 are perspective inverse, solid form illustrations of various cooling aperture geometries.
Figure 9:
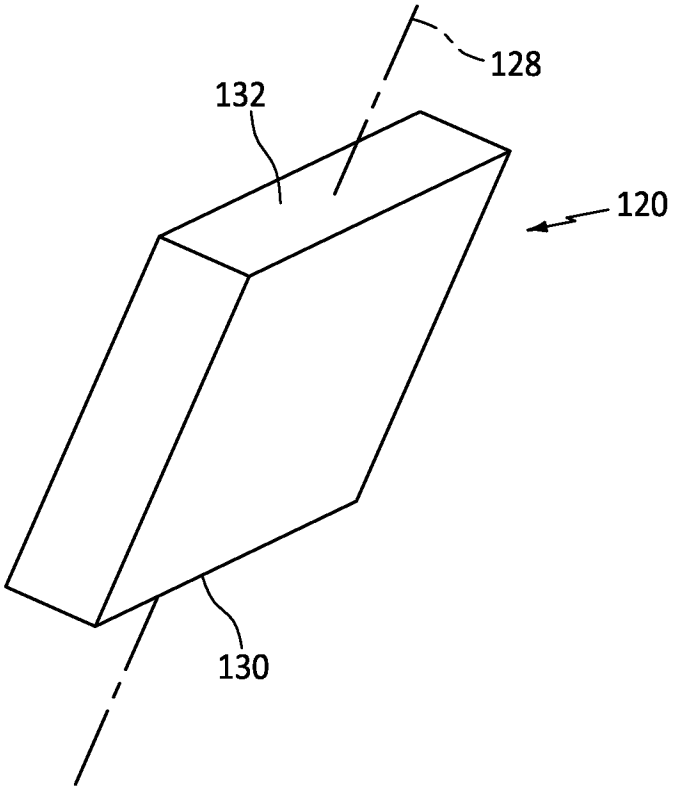

In some embodiments, referring to FIGS. 7 and 8, one, some or all of the cooling apertures 120 may each be configured with a cross-sectional geometry (e.g., shape, area, etc.) which changes as the respective cooling aperture 120 extends along its centerline 128. The cross-sectional shape of each cooling aperture 120 of FIGS. 7 and 8, for example, changes as the respective cooling aperture 120 extends along its centerline 128 from (or about) its aperture inlet 130 to (or about) its aperture outlet 132. In the specific embodiment of FIGS. 7 and 8, the aperture inlet 130 has a round (e.g., circular, elliptical, etc.) shape when viewed, for example, in a reference plane perpendicular to the centerline 128. The aperture outlet 132, on the other hand, has a polygonal (e.g., rectangular, square, diamond, trapezoidal, etc.) shape when viewed, for example, in a reference plane perpendicular to the centerline 128. The cross-sectional area of each cooling aperture 120 of FIGS. 7 and 8 may also or alternatively increase as the respective cooling aperture 120 extends along its centerline 128 from (or about) its aperture inlet 130 to (or about) its aperture outlet 132. With this arrangement, the aperture inlet 130 may from a metering orifice for the respective cooling aperture 120 that meters the flow of the cooling air from the diffuser plenum 60 into the respective cooling aperture 120. The present disclosure, however, is not limited to such an exemplary cooling aperture arrangement. For example, referring to FIGS. 9 and 10, one, some or all of the cooling apertures 120 (shown in inverse, solid form for ease of illustration) may alternatively each be configured with a cross-sectional geometry (e.g., shape, area, etc.) which is uniform (the same) as the respective cooling aperture 120 extends along its centerline 128.

Figure 12:
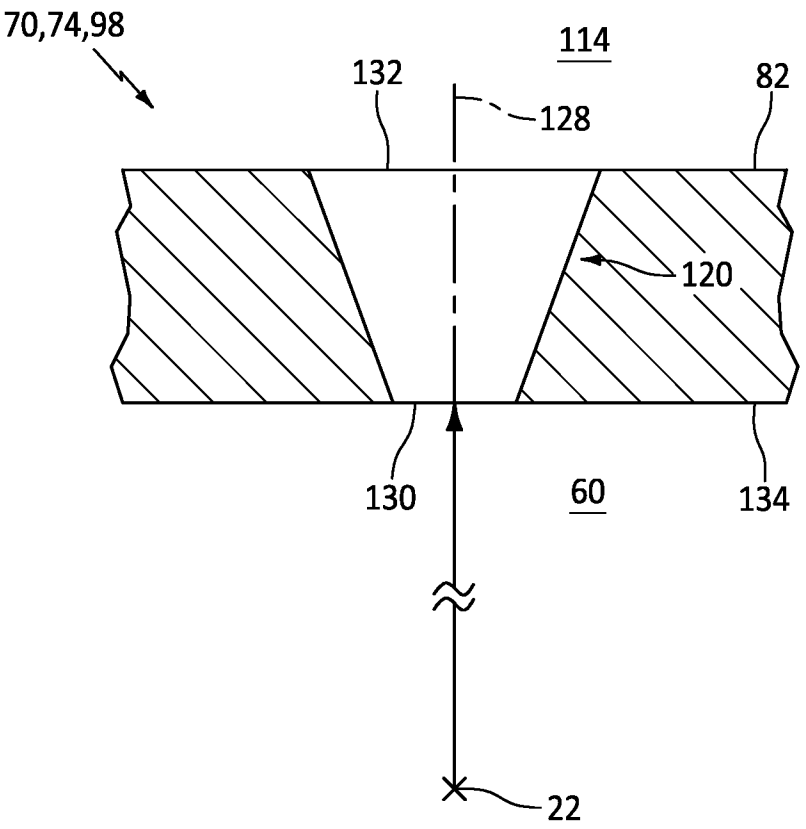
FIG. 12 is a partial cross-sectional illustration of the cooling structure with a divergent cooling aperture.
Figure 11:
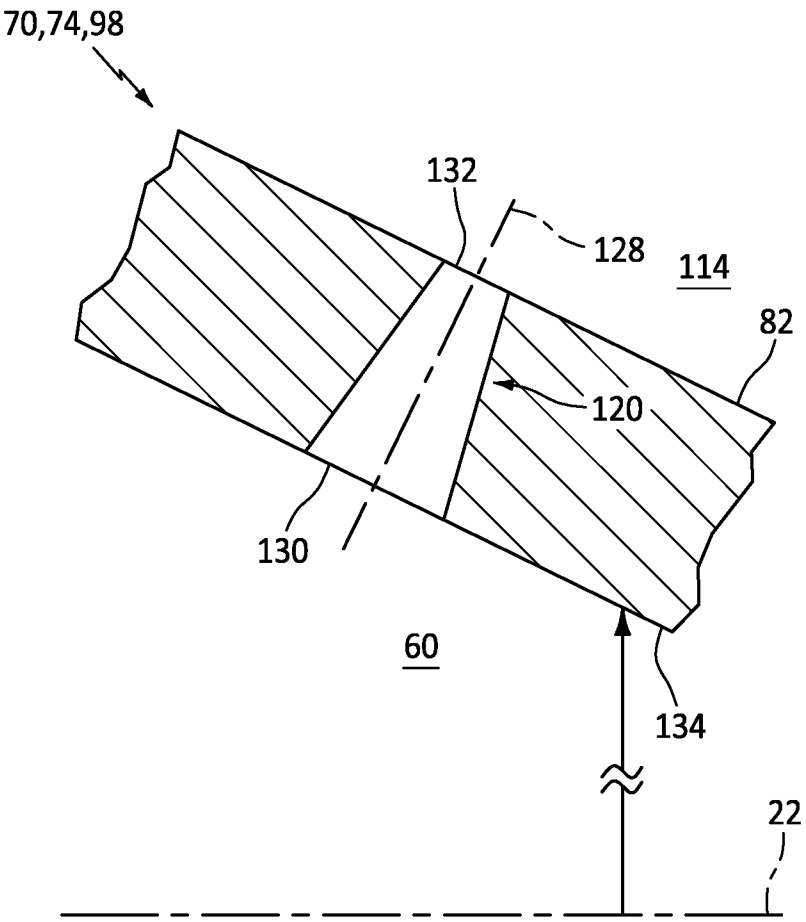
FIG. 11 is a partial side sectional illustration of the cooling structure with a convergent cooling aperture.

In some embodiments, referring to FIG. 11, one, some or all of the cooling apertures 120 may each laterally converge (e.g., in a general axial direction along the axis 22) as the respective cooling aperture 120 extends along its centerline 128 from (or about) its aperture inlet 130 to (or about) its aperture outlet 132. Referring to FIG. 12, one, some or all of the cooling apertures 120 may also or alternatively laterally diverge (e.g., in a general circumferential direction about the axis 22) as the respective cooling aperture extends along its centerline 128 from (or about) its aperture inlet 130 to (or about) its aperture outlet 132.

In some embodiments, referring to FIG. 2, the combustor 52 may be cantilevered within the diffuser plenum 60. For example, the only points of attachment between the combustor 52 and other structures of the turbine engine 20 may be at (A) a connection between the outer combustor wall 72 and the turbine nozzle outer platform 76 and (B) a connection between the inner combustor wall 74 and the intermediate structure 79. In other embodiments, however, additional attachments may be provided to further support and/or otherwise interconnect the combustor 52 to the surrounding structures of the turbine engine 20.

At least a portion (or an entirety) of the stationary structure 38 may be formed as a monolithic body 142; see also FIG. 1. At least the stationary structure members 52, 62, 64, 66, 68 and 70 of FIG. 2, for example, are included in the monolithic body 142. Herein, the term "monolithic" may describe an apparatus which is formed as a single, unitary body. The stationary structure members 52, 62, 64, 66, 68 and 70, for example, may be additively manufactured, cast, machined and/or otherwise formed together as an integral, unitary body. By contrast, a non-monolithic body may include multiple parts which are discretely formed from one another, where those parts are subsequently mechanically fastened and/or otherwise attached to one another.

The turbine engine 20 is described above as a single spool, radial-flow turbojet gas turbine engine for ease of description. The present disclosure, however, is not limited to such an exemplary turbine engine. The turbine engine 20, for example, may alternatively be configured as an axial flow gas turbine engine. The turbine engine 20 may be configured as a direct drive gas turbine engine. The turbine engine 20 may alternatively include a geartrain that connects one or more rotors together such that the rotors rotate at different speeds. The turbine engine 20 may be configured with a single spool (e.g., see FIG. 1), two spools, or with more than two spools. The turbine engine 20 may be configured as a turbofan engine, a turbojet engine, a propfan engine, a pusher fan engine or any other type of turbine engine. In addition, while the turbine engine 20 is described above with an exemplary reverse flow annular combustor, the turbine engine 20 may also or alternatively include any other type/configuration of annular, tubular (e.g., CAN), axial flow and/or reverse flow combustor. The present disclosure therefore is not limited to any particular types or configurations of turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure.

Accordingly, the present disclosure is not to be restricted except in light of the attached claims and their equivalents.

What is claimed is:

1. An assembly for a turbine engine, comprising:

a nozzle structure including a first platform, a second platform and a plurality of nozzle vanes arranged circumferentially about an axis, the plurality of nozzle vanes extending radially between and connected to the first platform and the second platform; and a combustor wall comprising a plurality of apertures, an upstream portion of the combustor wall radially between and bordering a plenum and a combustion chamber, a downstream portion of the combustor wall radially between and bordering the plenum and a gap, the downstream portion of the combustor wall axially overlapping the nozzle structure with the gap formed by and extending between the combustor wall and the first platform, and the plurality of apertures extending through the downstream portion of the combustor wall and aligned with the plurality of nozzle vanes.

2. The assembly of claim 1, wherein each of the plurality of apertures is configured to direct air, received from the plenum, across the gap onto the first platform.

3. The assembly of claim 1, wherein the plurality of nozzle vanes comprise a first nozzle vane; and the plurality of apertures comprise a first aperture, and the first aperture is axially and circumferentially aligned with the first nozzle vane.

4. The assembly of claim 3, wherein the plurality of nozzle vanes further comprise a second nozzle vane circumferentially neighboring the first nozzle vane; and the plurality of apertures further comprise a second aperture, and the second aperture is circumferentially aligned with a channel between the first nozzle vane and the second nozzle vane.

5. The assembly of claim 1, wherein each of the plurality of apertures is circumferentially aligned with a respective one of the plurality of nozzle vanes.

6. The assembly of claim 1, wherein the plurality of apertures comprise a first aperture;

the first aperture extends along a centerline through the downstream portion of the combustor wall from the plenum to the gap;

the centerline is coincident with a point on a surface of the first platform; and the centerline is angularly offset from a normal line projecting out from the point on the surface of the first platform by an acute angle.

7. The assembly of claim 1, wherein the plurality of apertures comprise a first aperture;

the first aperture extends along a centerline through the downstream portion of the combustor wall from the plenum to the gap; and at least a portion of the first aperture along the centerline has a round cross-sectional geometry.

8. The assembly of claim 1, wherein the plurality of apertures comprise a first aperture;

the first aperture extends along a centerline through the downstream portion of the combustor wall from the plenum to the gap; and at least a portion of the first aperture along the centerline has a polygonal cross-sectional geometry.

9. The assembly of claim 1, wherein the plurality of apertures comprise a first aperture; and at least a portion of the first aperture laterally converges as the first aperture extends through the downstream portion of the combustor wall towards the gap.

10. The assembly of claim 1, wherein the plurality of apertures comprise a first aperture; and at least a portion of the first aperture laterally diverges as the first aperture extends through the downstream portion of the combustor wall towards the gap.

11. The assembly of claim 1, wherein the plurality of apertures include a first set of apertures and a second set of apertures;

the first set of apertures are arranged in a first circumferential array about the axis; and the second set of apertures are arranged in a second circumferential array about the axis, and each aperture in the second set of apertures is circumferentially aligned with a respective aperture in the first set of apertures.

12. The assembly of claim 1, wherein the plurality of apertures include a first set of apertures and a second set of apertures;

the first set of apertures are arranged in a first circumferential array about the axis; and the second set of apertures are arranged in a second circumferential array about the axis, and each aperture in the second set of apertures is circumferentially aligned with a respective circumferentially neighboring pair of apertures in the first set of apertures.

13. The assembly of claim 1, further comprising:

a turbine wall axially overlapping the downstream portion of the combustor wall and bordering the plenum; and an intermediate structure extending between a downstream end of the first platform and an upstream end of the turbine wall;

the downstream portion of the combustor wall extending axially to the intermediate structure.

14. The assembly of claim 1, wherein the gap is fluidly coupled to the combustion chamber at an upstream end of the first platform.

15. The assembly of claim 1, wherein the first platform is an inner platform radially outboard of and circumscribing the downstream portion of the combustor wall; and the second platform is an outer platform radially outboard of and circumscribing the inner platform.

16. The assembly of claim 1, further comprising:

a second combustor wall projecting axially to and connected to the second platform;

the combustion chamber extending radially between the combustor wall and the second combustor wall.

17. An assembly for a turbine engine, comprising:

a nozzle structure including a first platform, a second platform and a plurality of nozzle vanes arranged circumferentially about an axis, each of the plurality of nozzle vanes extending radially from the first platform to the second platform; and a combustor wall comprising a plurality of apertures, an upstream portion of the combustor wall radially between and lining a plenum and a combustion chamber, a downstream portion of the combustor wall radially between and lining the plenum and a channel, the downstream portion of the combustor wall axially overlapping the nozzle structure with the channel formed by and extending between the combustor wall and the first platform, and the plurality of apertures configured to direct air, received from the plenum, across the channel and onto a surface of the first platform located opposite the plurality of nozzle vanes.

18. The assembly of claim 17, wherein the plurality of apertures comprise a first aperture;

the first aperture is configured to direct a portion of the air along a trajectory across the channel to a point on the surface of the first platform, and the trajectory is angularly offset from a normal line projecting out from the point on the surface of the first platform by an angle greater than twenty degrees.

19. The assembly of claim 17, further comprising:

a turbine wall axially overlapping the downstream portion of the combustor wall and bordering the plenum; and an intermediate structure extending between and formed integral with a downstream end of the first platform and an upstream end of the turbine wall;

the downstream portion of the combustor wall extending axially to and formed integral with the intermediate structure, wherein the plurality of apertures extend through the downstream portion of the combustor wall.

20. An assembly for a turbine engine, comprising:

a monolithic body extending axially along and circumferentially about an axis, the monolithic body including an outer wall, an inner wall, an intermediate structure, a combustor wall, a plenum and a channel;

the inner wall radially inboard of and axially overlapping the outer wall;

the intermediate structure extending between and connected to an axial forward end of the outer wall and an axial forward end of the inner wall;

a downstream portion of the combustor wall projecting axially to and connected to the intermediate structure, the plenum radially between and formed by the combustor wall and the inner wall, and the channel radially between and formed by the downstream portion of the combustor wall and the outer wall; and a plurality of apertures extending radially across the downstream portion of the combustor wall and fluidly coupling the plenum to the channel.

* * * * *